US007614829B2

(12) United States Patent
Thomas, Jr.

(10) Patent No.: US 7,614,829 B2
(45) Date of Patent: Nov. 10, 2009

(54) EXTENDIBLE BUILDING POST

(76) Inventor: Samuel M. Thomas, Jr., 252 Willow Lake Dr., Aiken, SC (US) 29803

( * ) Notice: Subject to any disclaimer, the term of this patent is extended or adjusted under 35 U.S.C. 154(b) by 1013 days.

(21) Appl. No.: 11/053,331

(22) Filed: Feb. 9, 2005

(65) Prior Publication Data

US 2006/0177277 A1 Aug. 10, 2006

(51) Int. Cl.
*E04H 12/18* (2006.01)

(52) U.S. Cl. ..... 405/231; 52/632; 114/44; 405/218

(58) Field of Classification Search ..... 405/3, 405/196, 197, 231, 212, 215, 216; 187/213, 187/215, 272, 274; 52/632, 730.1; 114/44, 114/48

See application file for complete search history.

(56) References Cited

U.S. PATENT DOCUMENTS

| | | | | | |
|---|---|---|---|---|---|
| 3,736,759 | A * | 6/1973 | Blose | 405/216 |
| 3,956,542 | A * | 5/1976 | Roberti | 428/35.6 |
| 3,968,860 | A | 7/1976 | Atkey | 187/272 |
| 4,075,719 | A | 2/1978 | Sullivan | 5/87.1 |
| 4,095,677 | A | 6/1978 | Johannson | 187/272 |
| 4,195,948 | A | 4/1980 | Vancil | 405/3 |
| 4,773,346 | A | 9/1988 | Blanding et al. | 114/45 |
| 4,900,187 | A | 2/1990 | Uchida et al. | 405/3 |
| 5,007,121 | A | 4/1991 | McEathron | 4/566.1 |
| 5,027,446 | A | 7/1991 | Robertson | 4/254 |
| 5,099,778 | A | 3/1992 | Palen | 114/45 |
| 5,181,693 | A | 1/1993 | Lorenz | 254/2 R |
| 5,361,874 | A | 11/1994 | Brown | 187/253 |
| 5,465,433 | A * | 11/1995 | Nolan | 4/496 |
| 5,690,315 | A | 11/1997 | Thomas | 254/93 R |
| 5,692,857 | A | 12/1997 | Ness | 405/3 |
| 5,715,545 | A | 2/1998 | Forwick | 4/563.1 |
| 5,919,000 | A | 7/1999 | Unkle | 405/3 |
| 6,042,301 | A * | 3/2000 | Sovran | 405/112 |
| 6,070,278 | A | 6/2000 | Smith | 4/496 |
| 6,305,668 | B1 | 10/2001 | Edens | 254/93 R |
| 6,422,349 | B1 * | 7/2002 | Veletovac | 187/272 |
| 2004/0089212 | A1 | 5/2004 | Vinnik | 114/44 |
| 2005/0249556 | A1 * | 11/2005 | Colbert | 405/216 |

FOREIGN PATENT DOCUMENTS

| | | |
|---|---|---|
| WO | WO 90/01015 | 2/1990 |

OTHER PUBLICATIONS

Website "uh.edu/engines/epi279.htm," "Engines of our Ingenuity No. 279, Hydraulic Lifts" by John H. Lienhard, printed Sep. 2, 2004.
Website "home-elevator.net/products/vision/500ec.htm," "Nationwide Lifts," printed Sep. 2, 2004.

* cited by examiner

*Primary Examiner*—Tara Mayo-Pinnock
(74) *Attorney, Agent, or Firm*—Richard C. Litman

(57) ABSTRACT

The extendible building post includes a telescoping hydraulic cylinder integrated within a construction member externally configured and dimensioned essentially identically to a conventional building construction member, e.g., a four-by-four or six-by-six length of lumber, or alternatively a plastic column. The hydraulic system may be formed of stock plastic pipe and fittings, and may use water as the working fluid. The device may include insulation and a heating system to prevent freezing when used in such an environment, with certain types of insulation also providing additional rigidity for the hydraulic assembly.

7 Claims, 4 Drawing Sheets

EXTENDIBLE BUILDING POST

BACKGROUND OF THE INVENTION

1. Field of the Invention

The present invention relates generally to building structural components. More specifically, the present invention comprises various embodiments of an extendible post that may be used in building construction, with the post including a hydraulic strut mechanism integrated therewith.

2. Description of the Related Art

Many people are requesting and demanding additional comfort and convenience features in their homes today. In many instances, such features are not merely conveniences, but are necessities for providing assistance to those who live in such homes. Examples of such are residential wheelchair lifts and elevators, serving the needs of physically handicapped and/or infirm residents.

In the past, the needs of such residents have been handled by providing wheelchair ramps for access from the exterior of the home, and through other ground floor accommodations. In some instances, chair lifts have been installed along existing stairway runs for access to higher floors. Generally speaking, however, access, particularly to the higher levels of residences, has been relatively limited by the lack of economical means for lifting a person from one floor or level to the next. Conventional residential lifting devices tend to be complex and expensive, comprising elevator systems utilizing self-contained hydraulic power packs and/or electric motors. Not only is the initial purchase price of such devices relatively high, but the installation is labor intensive and accordingly costly.

Thus, an extendible building post solving the aforementioned problems is desired.

SUMMARY OF THE INVENTION

The extendible building post includes a telescoping hydraulic strut therein, within an elongated box-like structure having an external configuration and dimensions essentially identical to a conventional structural member used in building construction. However, the hydraulic mechanism is adapted particularly for operation using relatively low pressures, such as pressure from conventional municipal water supply systems. The hydraulic mechanism is preferably formed of stock plastic components, such as polyvinyl chloride (PVC) pipe and fittings, for economy and resistance to corrosion when using water as the working fluid.

The housing for the hydraulic device is constructed to have a configuration and dimensions essentially identical to a conventional building post, e.g., 3.5×3.5 inches, to serve as a conventional "four-by-four"; 5.5×5.5 inches for use as a six-by-six, etc. Larger diameter hydraulic devices for greater lifting capacity require larger post dimensions. A specially configured piston seal may be provided to accommodate the relatively uneven interior of the plastic pipe preferably used in the hydraulic system of the present invention. The device may be installed vertically, horizontally, or at other angles, depending upon installation requirements.

These and other features of the present invention will become readily apparent upon further review of the following specification and drawings.

BRIEF DESCRIPTION OF THE DRAWINGS

FIG. 1 is an environmental, perspective view of the installation of a pair of extendible building posts according to the present invention, for use as a wheelchair lift or the like.

Similar reference characters denote corresponding features consistently throughout the attached drawings.

DETAILED DESCRIPTION OF THE PREFERRED EMBODIMENTS

Figure 1:
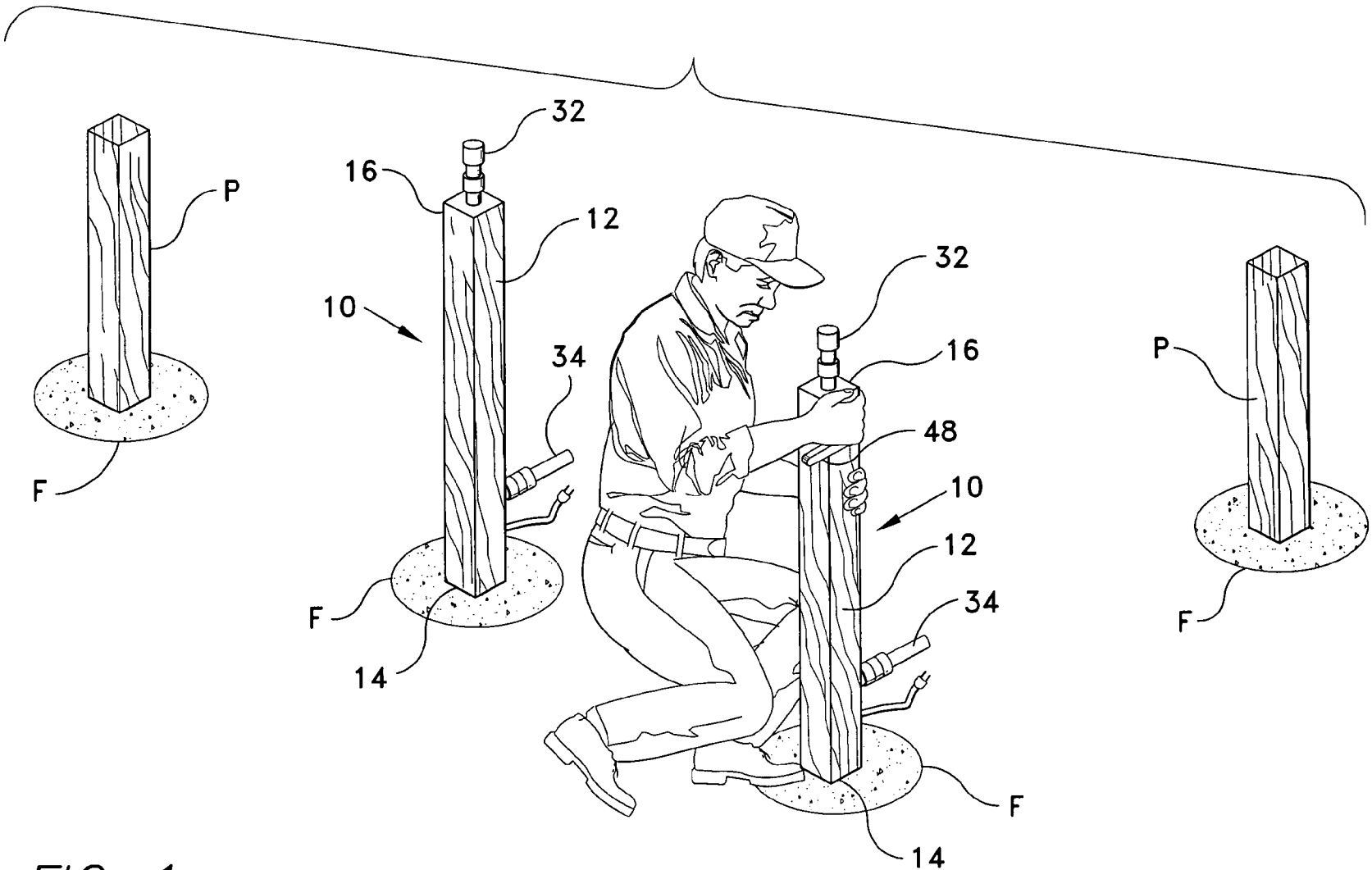
Figure 2:
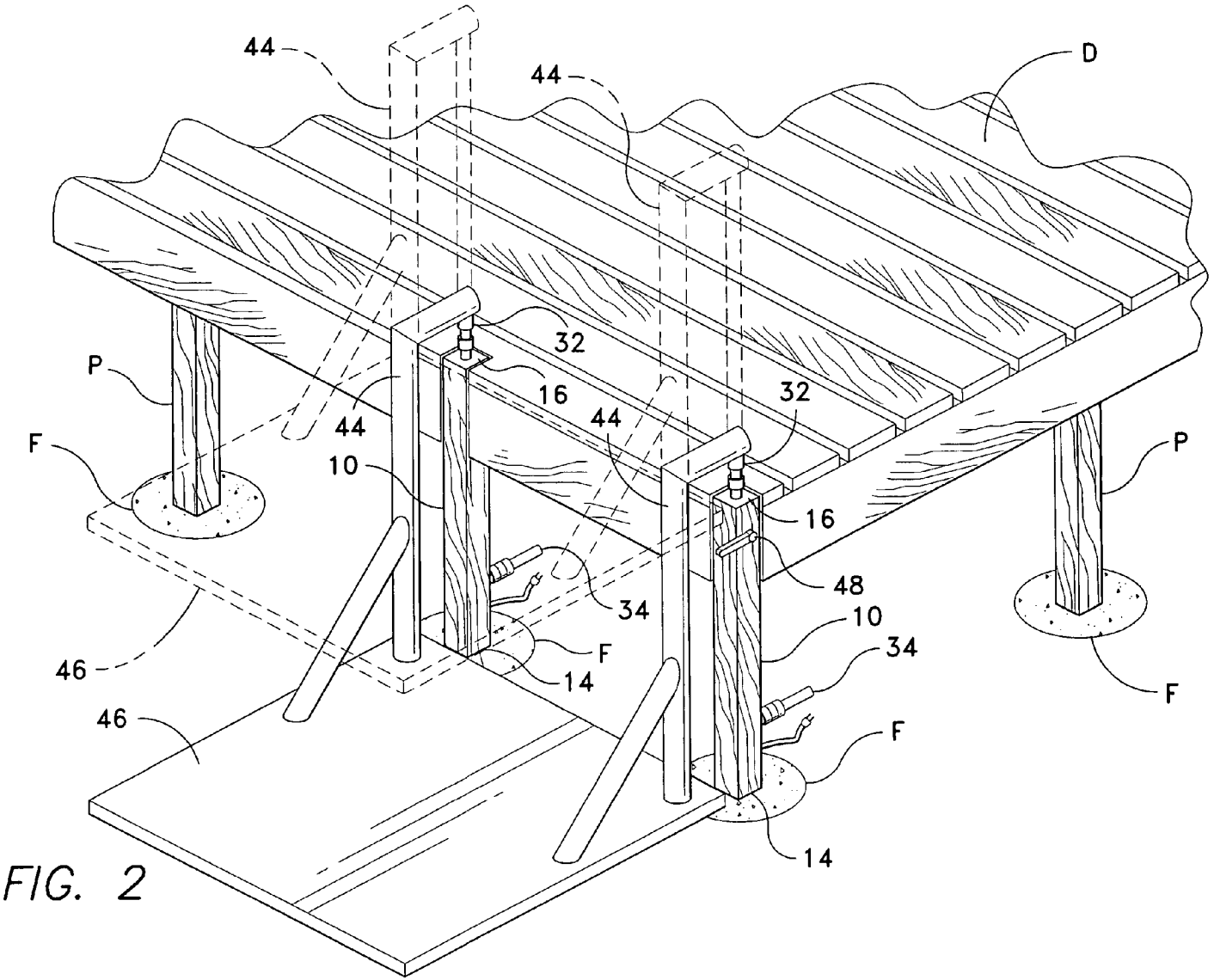
FIG. 2 is an environmental perspective view of the completed installation of FIG. 1, showing the integration of the posts in the building structure.

The present invention comprises various embodiments of an extendible building post, and an exemplary lifting device or platform which may be constructed using the present building posts. FIGS. 1 and 2 illustrate the installation of an exemplary extendible post 10 of the present invention in the construction of a wheelchair lift or the like for a residence or similar structure. Initially, however, attention is directed to FIGS. 3 and 4, which respectively illustrate a pair of embodiments 10 and 10*a* of the present extendible building post.

Figure 3:
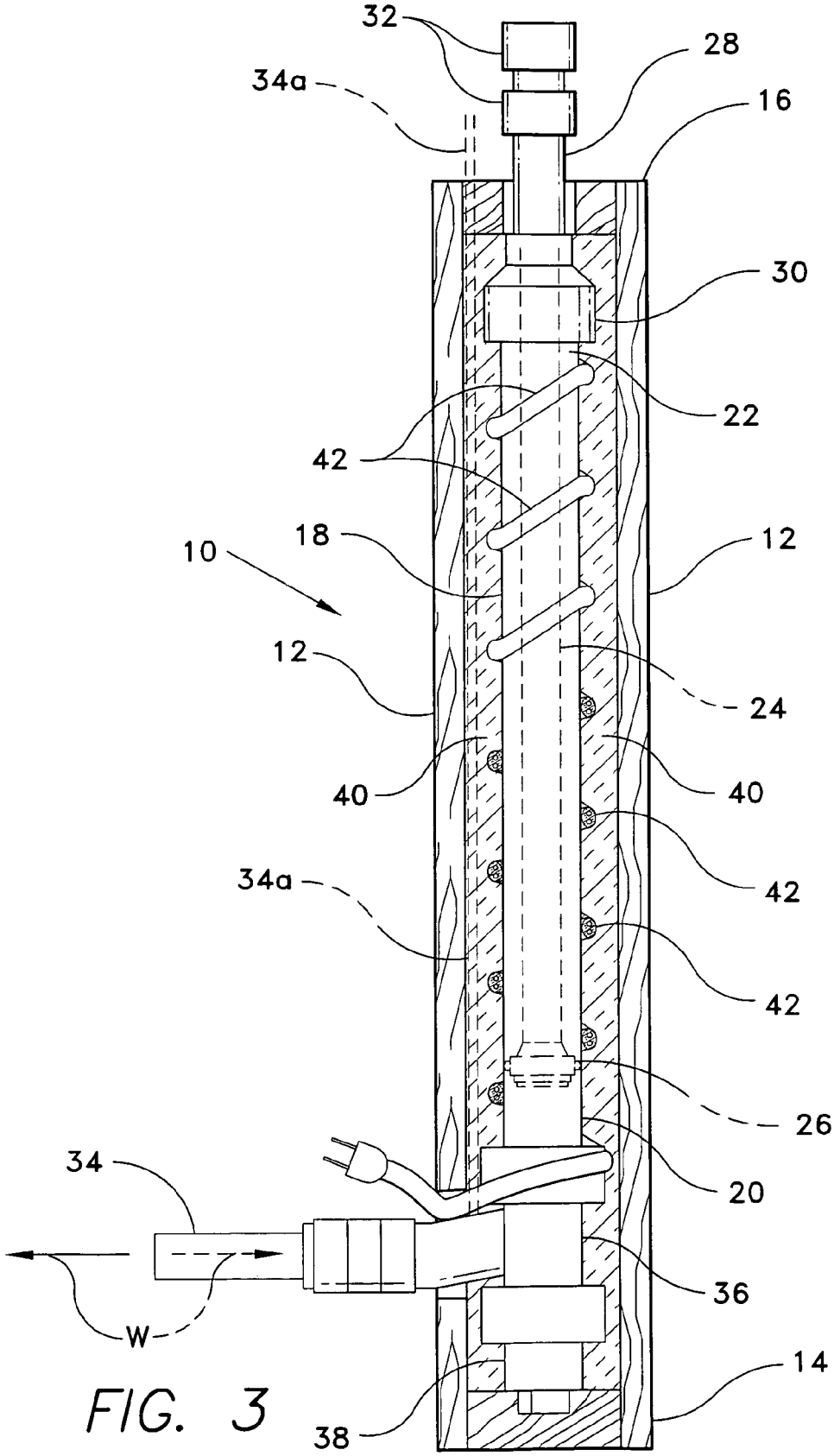
FIG. 3 is an elevation view in section of an exemplary extendible building post, showing features and details thereof.

The extendible building post 10 of FIG. 3 comprises a sturdy, elongate, hollow box-like building construction member constructed of a series of flat wood planks or boards 12 to form a square or rectangular cross section. The structural member or post 10 includes a base end 14 and an opposite extension end 16, with the length between the two ends 14 and 16 being configured as desired, depending upon the application of the unit. In the example of FIGS. 1 and 2, relatively short posts 10 having lengths on the order of three feet or so are shown in an installation for a wheelchair lift platform or the like, from an on-grade level to an elevated deck. However, it will be seen that the present posts or structural members 10 may have lengths of several feet and may accommodate lifts surpassing one story in height, if so desired.

Preferably, the boards 12 are dimensioned to provide lateral external dimensions equal to conventional wood structural members used in building construction. For example, the wood outer structure could be formed of half inch thick planks having widths sufficient to form overall lateral dimensions of 3.5" by 3.5", which are the dimensions of a nominal four-by-four lumber post. Such a construction would provide interior dimensions of two and one half inches square for the installation of a nominal two-inch, schedule 40 plastic (e.g., polyvinyl chloride, or PVC) pipe. Such a pipe has an internal area of about 3.3 square inches, sufficient to produce a lifting or extending force of about two hundred sixty-four pounds when a working force pressure of eighty pounds per square inch (psi) is used, as is typical of the pressure provided in many domestic water supplies. The boards or materials forming the outer structure 12 may be somewhat thicker to provide greater compressive strength if so required, with the internal extension mechanism being accordingly smaller in diameter.

It will be appreciated that the above example is but one of many different sizes or dimensions of post which may be constructed in accordance with the present invention. Another example may use outer dimensions of 5.5" by 5.5" where a larger column is desired or required, to provide a column externally equal to a nominal six-by-six post. Such a column or post may accommodate up to four-inch schedule 40 plastic pipe, depending upon the thickness of the outer structure planks 12 and external dimensions of joints, fittings, etc. required for the pipe.

Such a four inch nominal pipe has an internal area of about 12.5 inches, which would provide an extension force of about one thousand pounds, using 80 psi as the working pressure.

The interior of the column or post 10 includes an elongate, hollow tubular cylinder 18 installed therein, with the cylinder 18 having a base end 20 disposed within the base end 14 of the outer structure 12 and an opposite piston extension end 22 at the extension end 16 of the outer structure 12. An elongate, smaller diameter tube 24 (shown in broken lines in FIGS. 3 and 4) is installed concentrically to slide axially within the cylinder 18, with the tube 24 acting as a piston when a working fluid under pressure is introduced into the base end 20 of the cylinder 18. The piston tube 24 has a base end comprising a seal assembly 26 and resilient seal to conform to the interior walls of the cylinder 18, and an opposite outer end 28 extending from the extension end 16 of the extension post structure 10. Appropriate reducers 30 and end caps 32 of conventional components may be provided to complete the upper or extension end of the assembly. The piston 24 may alternatively be formed of a solid rod, if so desired.

The device includes a working fluid supply line or pipe 34 extending from the base end 20 of the cylinder 18, and communicating fluidly with the interior thereof. The supply line 34 may connect to the base end 20 of the cylinder 18 by means of a suitable tee 36 and/or other conventional fittings, with the cylinder base end 20 being closed by an appropriate cap assembly 38. The working fluid is represented by the working fluid arrows W shown extending into and from the supply line 34 in FIG. 3.

The present extendible building post 10 (or 10*a*, of FIG. 4) is well suited for installation in various applications in private residences, small businesses, and other similar structures where relatively light lifting is required over a span or height of several feet or less. It will be seen that the present extendible post may also be oriented other than vertically to apply horizontal forces or forces along a sloping axis if so desired. In any event, as the loads developed by the device are relatively light in comparison to multi-ton force hydraulic devices, a relatively low-pressure working fluid and relatively low strength components may be used in the construction of the present post. A source of fluid pressure is almost universally present in most structures where the present post may be installed, in the form of a domestic water supply. Such water supplies typically provide water at from 80 to 100 psi pressure, with most well pumps being adjusted to provide about the same pressure.

Accordingly, the pipe, piston, and fittings used in the present extendible post need not be of extremely high strength. Schedule 40 polyvinyl chloride (PVC) or similar plastic pipe provides more than enough strength to handle normal domestic water supply pressures, with such a plastic pipe system providing the additional advantage of corrosion resistance when water is used as the working fluid. Such a system does not require any form of pump or pressure reservoir, as would a conventional system utilizing hydraulic fluid. The only requirement of the present system is some means of disposal for the water after use, e.g., to a storage container for later use in a garden or on a lawn, or emptied into a swimming pool, toilet tank, etc. Alternatively, a pump may be used to provide pressure in a closed system, if so desired. However, the water used per cycle of the present extension post is relatively small, e.g., about two quarts for a system with a three foot operating range using nominal two inch, schedule 40 PVC pipe for the outer cylinder.

Of course, water has the disadvantage of freezing in low temperatures. Accordingly, means for the prevention of freezing may be provided in the present extendible post, particularly where such a post is installed outdoors in colder climates or where freezing conditions may be encountered. It will be noted in the cross-sectional views of FIGS. 3 and 4, that the interior volume between the outer structure 12 of the post 10 and the extension cylinder 18 is filled with an insulation material 40. Depending upon the insulation material used, this insulation 40 not only serves to prevent water within the cylinder 18 from freezing, but may also serve to stiffen the plastic cylinder 18 for greater bending resistance when the assembly is in compression during operation. Foam plastics that set or cure into a relatively rigid monolithic unit are well suited for such purposes and may be applied to the interior volume of the post 10 after assembly of the mechanism and before closure.

In certain installations, it may be necessary to provide an active means for preventing freezing when water is used as the working fluid W. Accordingly, a linear heating element 42 is shown wrapped about the cylinder 18, in FIGS. 3 and 4. Such heating elements 42, often called "heat tapes," are readily available and conventionally wrapped around external pipes and the like to prevent their freezing in cold weather. Many such devices are automatically controlled by conventional thermostats to cycle the electrical power on or off in accordance with the temperature.

In some cases, it may be desirable to install the present extendible building posts below grade. In such circumstances, the routing of the fluid supply line to the base of the device may be cumbersome. Accordingly, an internal fluid supply line 34*a* may be installed within the interior volume of the outer case or structure 12, if so desired. The internal supply line 34*a* extends from the upper or extension end 16 of the post 10, to the base end 20 of the cylinder 18. Water or other working fluid may be introduced to the system at the upper or extension end 16 of the post 10, with the remainder of the post being buried or otherwise inaccessible.

Figure 4:
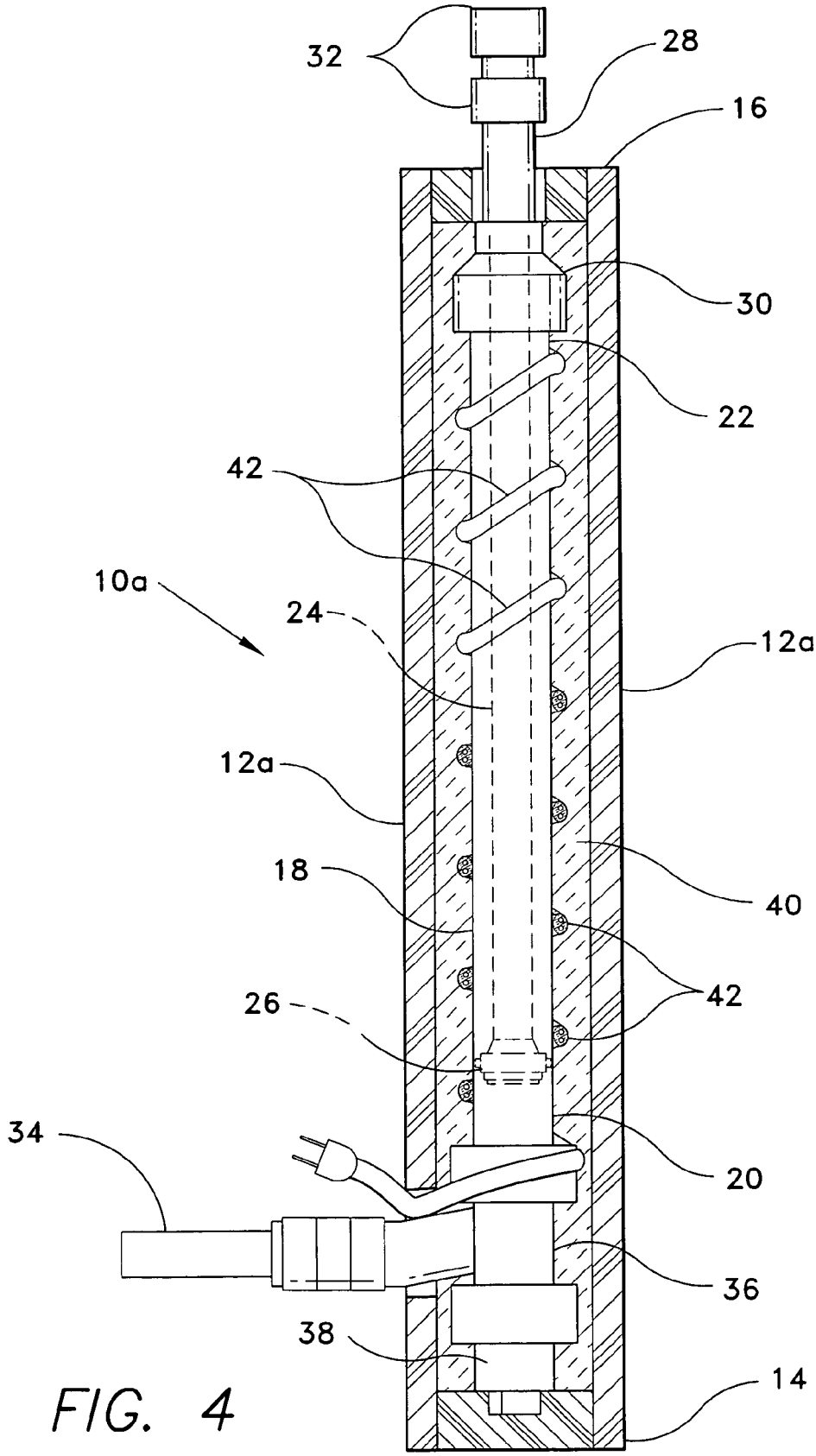
FIG. 4 is an elevation view in section of an alternative embodiment post having a plastic exterior housing.

In some installations, such as the buried installation discussed immediately above, the use of wood for the external structural member 12 may not be suitable due to potential long term degradation of the material, even when pressure treated. Accordingly, the outer structural member may be formed of other materials, as desired or required. FIG. 4 provides a cross-sectional elevation view of an extendible column or post 10*a* incorporating all of the structure and features of the post 10 of FIGS. 1 through 3, but using a plastic material (e.g., PVC sheet, etc.) for the outer structural components 12*a*. Alternatively, the outer structure could be formed of a cylindrical plastic shell having a larger diameter than the internal fluid cylinder 18, and may use a heavier pipe schedule (e.g., schedule 80) to provide a thicker wall for greater compressive strength, if desired. Other materials, e.g., cast, forged, or sheet metal, may be used to form the outer structure, if so desired.

The present extendible building post in its various embodiments may be used in innumerable different installations and environments, as desired. FIGS. 1 and 2 of the drawings illustrate one exemplary installation for a pair of the posts 10, in a wheelchair lift installation or the like in which the posts 10 are opposite one another relative to the span of the lift. In FIG. 1, two of the posts 10 are being installed with other conventional posts P for supporting a deck construction. The posts 10 and P may be set into the ground, or set into or mounted atop concrete footings F or other suitable base structure, as desired.

In FIG. 2, the elevated deck D construction is shown in its completed state. The two extendible building posts or columns 10 form integral components of the deck D, serving to support the deck D along with the conventional posts P. Lift struts 44 extend from the upper end caps 32 of the pistons of each of the posts 10, and downwardly along the exterior of each post 10 and essentially parallel to their respective posts 10. A lifting platform 46 extends from the lower ends of the two lift struts, with the lift struts 44 and lifting platform 46 serving as a wheelchair lift or the like. Additional conventional hardware, e.g., rollers or guides between the contact edges of the platform 46 and posts 10, attachment fittings between the upper ends of the lift struts 44 and the piston end caps 32, etc., are not shown, but are normally associated with such an installation.

The extendible posts 10 may be connected to a conventional domestic water supply under pressure, or to a well pump and pressurized reservoir, etc., as desired. Appropriate valving may be controlled by a control lever 48 extending from one of the posts 10, or other suitable control means as desired. Only a single control lever or switch is required, as the two posts 10 may incorporate parallel valve systems to control inflow and outflow. The control lever 48 may actuate a single conventional three way valve (not shown), with operation of the lever 48 in one direction serving to close the outflow side and open the pressurized inflow side to fill the cylinders within the posts 10, thereby lifting the platform 46 (and any reasonable load thereon), as shown by the broken line platform 46 position in FIG. 2. The use of a domestic water supply for the operation of the present extendible posts also simplifies the system, in that no pressure relief valves are required due to the relatively low pressure of such water systems. Movement of the lever 48 in the opposite direction reverses the valve, closing the inflow and opening the outflow. The weight of the platform 46 (and any load thereon) results in the platform 46 lowering to the base of the posts 10, as shown in solid lines in FIG. 2. A suitable conventional restrictor valve, not shown, may be placed in the outflow side of the control valve to reduce the descent rate of the platform 46, if required.

In conclusion, the present extendible lifting posts in their various embodiments provide a much-needed means for both amateur and professional builders to incorporate lifting devices integrally in a building structure. While the examples shown and described herein are of relatively short posts, it will be recognized that the length and/or lift height of posts constructed in accordance with the present invention may be much greater than illustrated herein, and may be constructed to extend sufficiently to power an elevator or similar lift between stories of a home, small business, or similar structure.

The present extendible posts may be provided in various sizes, according to the compressive strength required and/or the operating pressure needed for the installation. A range of prefabricated posts may be provided in various widths and lengths as a readily available article in building supply stores, allowing the constructor to select and purchase the desired posts for a given job and easily install them without need for additional work, other than connecting a water supply, and perhaps an electrical connection to prevent freezing. Accordingly, the present extendible posts serve to greatly reduce the cost of materials and labor in the construction of lift platforms, small elevators, and similar devices, and will be much appreciated by all who have need of such devices in a structure.

It is to be understood that the present invention is not limited to the embodiments described above, but encompasses any and all embodiments within the scope of the following claims.

I claim:

1. A lifting device, including:

at least one extendible building post, comprising:

an elongate, hollow building construction member having a closed base end and an extension end opposite the base end;

an elongate, hollow tube having a base end and a piston extension end opposite the base end, disposed within said building construction member, with said building construction member extending substantially the entire length of said elongate, hollow tube;

an elongate piston slidingly disposed within said tube, extending from the piston extension end thereof;

a working fluid supply line connected to and extending from the base end of said tube and adapted for connection to a source of fluid under pressure;

a lift strut extending from said piston, exteriorly of said tube;

said lift strut being disposed along said extendible building post and substantially parallel thereto; and a lifting platform extending laterally from said lift strut;

wherein said at least one extendible building post comprises two mutually opposed extendible building posts.

2. The lifting device according to claim 1, further including foam insulation filling said building construction member and surrounding said tube.

3. The lifting device according to claim 1, further including a selectively operable heating element surrounding said tube.

4. The lifting device according to claim 1, further comprising the working fluid, the working fluid being water.

5. The lifting device according to claim 1, wherein at least said tube, said piston, and said supply line are formed of stock plastic components.

6. The lifting device according to claim 1, wherein said building construction member is formed of plastic.

7. A lifting device, including:

at least one extendible building post, comprising:

an elongate, hollow building construction member having a closed base end and an extension end opposite the base end;

an elongate, hollow tube having a base end and a piston extension end opposite the base end, disposed within said building construction member, with said building construction member extending substantially the entire length of said elongate, hollow tube;

an elongate piston slidingly disposed within said tube, extending from the piston extension end thereof;

a working fluid supply line connected to and extending from the base end of said tube and adapted for connection to a source of fluid under pressure;

a lift strut extending from said piston, exteriorly of said tube;

said lift strut being disposed along said extendible building post and substantially parallel thereto; and a lifting platform extending laterally from said lift strut;

wherein said building construction member is made from a plurality of flat wood components.

* * * * *